United States Patent [19]

Moore

[11] Patent Number: 4,862,661

[45] Date of Patent: Sep. 5, 1989

[54] ENCLOSED STRUCTURE AND METHOD OF CONSTRUCTION

[76] Inventor: John V. Moore, 1104 Northpoint Building, 100 Miller Street, North Sydney, New South Wales, Australia, 2060

[21] Appl. No.: 98,388

[22] Filed: Sep. 18, 1987

Related U.S. Application Data

[63] Continuation-in-part of Ser. No. 723,312, Apr. 15, 1985, abandoned.

[30] Foreign Application Priority Data

Apr. 16, 1984 [AU] Australia ..... PG4597

[51] Int. Cl.[4] ..... E04B 1/32

[52] U.S. Cl. ..... 52/247; 52/248

[58] Field of Search ..... 52/192–197, 52/245, 248, 249, 726, 730, 247; 403/363, 388

[56] References Cited

U.S. PATENT DOCUMENTS

| | | | |
|---|---|---|---|
| 1,227,928 | 5/1917 | Perkins | 52/248 X |
| 2,074,592 | 3/1937 | Rowell | 52/248 X |
| 2,105,145 | 1/1938 | Gurney | 52/193 |
| 2,323,297 | 7/1943 | Collins . | |
| 2,501,951 | 3/1950 | Lintz | 52/248 |
| 3,140,885 | 7/1964 | Batis et al. | 403/363 |
| 4,044,517 | 8/1977 | Schroter | 52/248 |
| 4,453,351 | 6/1984 | Moore | 52/82 |

*Primary Examiner*—Carl D. Friedman

[57] ABSTRACT

An enclosed structure for containing particulate solids includes a plurality of circumferentially disposed vertical posts. Circumferentially directed girts extending horizontally are affixed to the posts and corrugated metal cladding is attached to the girts. The vertical spacing of the girts varies and they are closer together near the bottom of the structure.

8 Claims, 7 Drawing Sheets

ENCLOSED STRUCTURE AND METHOD OF CONSTRUCTION

This is a continuation-in-part application of Ser. No. 723,312, filed Apr. 15, 1985, now abandoned.

BACKGROUND OF THE INVENTION

1. Field of the Invention

This invention relates to an enclosed structure and has been devised particularly, though not solely, as a grain silo.

2. Description of the Prior Art

Most silos and containers or storage bins for large amounts of particulate solids, are made from reinforced concrete or heavy steel plate, or from a combination of heavy steel plate and lightweight steelwork. Such constructions require skilled engineering and manpower to erect and are also very costly to build.

Some silos are made entirely of lightweight steelwork but are in practice found to be susceptible to damage by wind when they are empty and to damage by grain pressures when they are being unloaded in a non-uniform way. Some of these structures are fabricated with corrugated sheeting disposed so that the ribs run horizontally that is circumferentially, around the silo. These structures are unhygienic since grain and grain dust tend to lodge on the corrugations and in laps and gaps in the sheeting so that they are prone to insect infestation.

It has been found in practice a desirable objective to dispose lightweight corrugated wall sheeting of grain silos in such a way that the ribs run vertically rather than circumferentially. This provides greater hygiene for storage of grain, since grain will then not readily adhere to wall. However it has been found in practice there are difficulties in this vertical arrangement of the wall sheeting corrugations.

Firstly there is a difficulty due to stiffness in the vertical direction which is caused by the phenomenon of the walls expanding outwards elastically as the silo is filled. In practice, this expansion causes a problem where the cladding is fastened to the floor or foundation which is unyielding. The vertical stiffness of the cladding material makes it unable to accommodate this movement above and the restraint below and this may lead to the sheeting being sheared open or cracked after a number of loadings.

There is also serious difficulty due to lack of stiffness in the horizontal direction which results in a weakness in resisting wind loads. So, in practice, wind girders have to be provided to safeguard the silo when it is empty.

A solution to the first of these difficulties has been proposed in U.S. Pat. No. 4,453,351 according to which a heavy steel plate is utilised for the bottom section of the wall. The plate is fixed the silo foundatios along its lower edge and to the cladding along its upper edge and has sufficient strength and flexibility to accomodate expansion of the silo. The steel plate arrangement is however, heavy and accordingly adds to the difficulty of assembly and cost of the silo.

U.S. Pat. No. 4,453,351 also describes a girt arrangement for stiffening the silo in which the girts comprise flat steel members joined by bolted steel angles welded to the girts. This arrangement can withstand the pressure of grain loads and the eccentric pressures due to wind loads and uneven grain loads, however the girts are heavy and significantly add to the cost of the silo. In addition, the flat steel girts do not provide significant strength against inwardly directed wind forces when the silo is empty so that additional strengthening is required to obtain sufficient resistance to wind damage.

The girts disclosed in U.S. Pat. No. 4,453,351 were joined using heavy steel plates and angle bars welded to the outside of the girts. This was due to the need to maintain a flush inside face in the girt members, because of the presence of the adjacent wall cladding, which inhibits the use of bolts passing through the girts. The connecting pieces in that invention were found in practice to be necessarily heavy and added significantly to the cost of the structure.

SUMMARY OF THE INVENTION

It is an object of the invention to provide an enclosed structure suitable for containing particulate solids and a method of construction which will overcome, or at least ameliorate, the above disabilities.

Accordingly, this invention consists in an enclosed structure suitable for containing particulate solids comprising a plurality of posts set on foundations so as to define the external boundary of said structure, a plurality of rafters extending upwardly and inwardly from each said post to a central point or ridge, a plurality of circumferential girts extending substantially horizontally between said posts so as to define the line of a cornerless substantially circular wall, vertically corrugated sheet wall cladding extending the height of said wall and being fixed to the foundations at its lower edge, said sheet cladding being located within the wall defined by said girts and being fastened to said girts, the vertical edges of adjoining sheets of cladding being secured together in a structural manner, and roof cladding being placed over said rafters to form a roof, wherein the ratio of the height to diameter of said wall is less than or equal to 1.0 and each said girt is formed by a plurality of elongate channel elements joined substantially end to end, said girts being disposed at intervals along the full height of said wall within the number of girts per unit length increasing toward the bottom of said wall such that in a lower region of said wall the girt spacings are less than the calculated girt spacing for maximum desired cladding load at the corresponding part of said wall to control the deflected profile shape of the wall cladding between the fixed lower edge and the expanding upper region of said wall.

Preferably, the lower region is that portion of the wall disposed a distance from the lower edge of less than about 2.0 to 4.5 times the calculated girt spacing for maximum desired cladding load at the lower edge of the wall.

In one embodiment the edge flanges of the channel elements are at right angles to the band. In another embodiment the edge flanges project in outwardly diverging directions.

The channel elements are preferably formed from high strength steel manufactured by Lysaght Brown Built Industries and known as "Hi-ten". This material is fully galvanised and has a strength which is much greater than that of ordinary structural grade steel.

In one embodiment, adjacent channel elements are joined by the elements overlapping and nesting one within the other. The elements are secured either by rivets or bolts through the overlapping band portions or bolts through overlapping edge flanges.

In another embodiment a plurality of channel elements are nested to form a composite girt of greater strength. Preferably, adjacent channel elements overlap so that joints in each element do not occur at the same circumferential point.

It will be apparent that in the nested or single channel element arrangement the edge flanges provide continuity of resistance to inwardly directed forces thus at least reducing the amount of additional wind stiffening required.

In some cases, additional wind stiffening may be eliminated.

BRIEF DESCRIPTION OF THE DRAWINGS

One embodiment of the invention will now be described, by way of example only, with reference to the accompanying drawings: in which.

DESCRIPTION OF THE PREFERRED EMBODIMENTS

Figure 1:
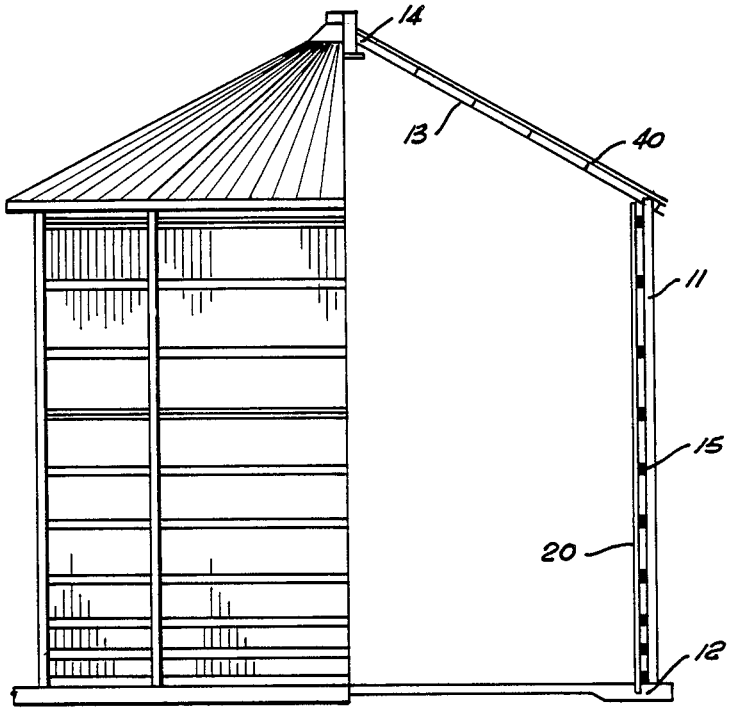
FIG. 1 is a part cross sectional elevation of an enclosed structure according to the invention.

Refering firstly to FIGS. 1 to 7 the preferred form of the invention provides an enclosed structure, particularly suitable for use as a grain silo, is constructed as follows.

A plurality of vertical posts 11 are provided set on foundations so as to define the line of a cornerless wall. In the preferred form of the invention shown in the accompanying drawings, 6, 8 or 12 vertical posts are provided set so as to define a circular wall.

The upperends of the posts are arranged to support roof rafters 13, which extend inwardly and upwardly from the posts to be a central receiving member point 14.

The vertical posts 11 are interconnected by a plurality of horizontal circumferential girts 15 which may for example be formed from "C" Section high strength steel sheet. The girts 15 form continuous circumferential hoops around the line of the posts 11. The girts may be attached to the posts 11 by bolting.

The roof framing of the embodiment shown in the accompanying drawings consist of a series of intersecting radial rafters which, in turn, support purlins 40.

Figure 2:
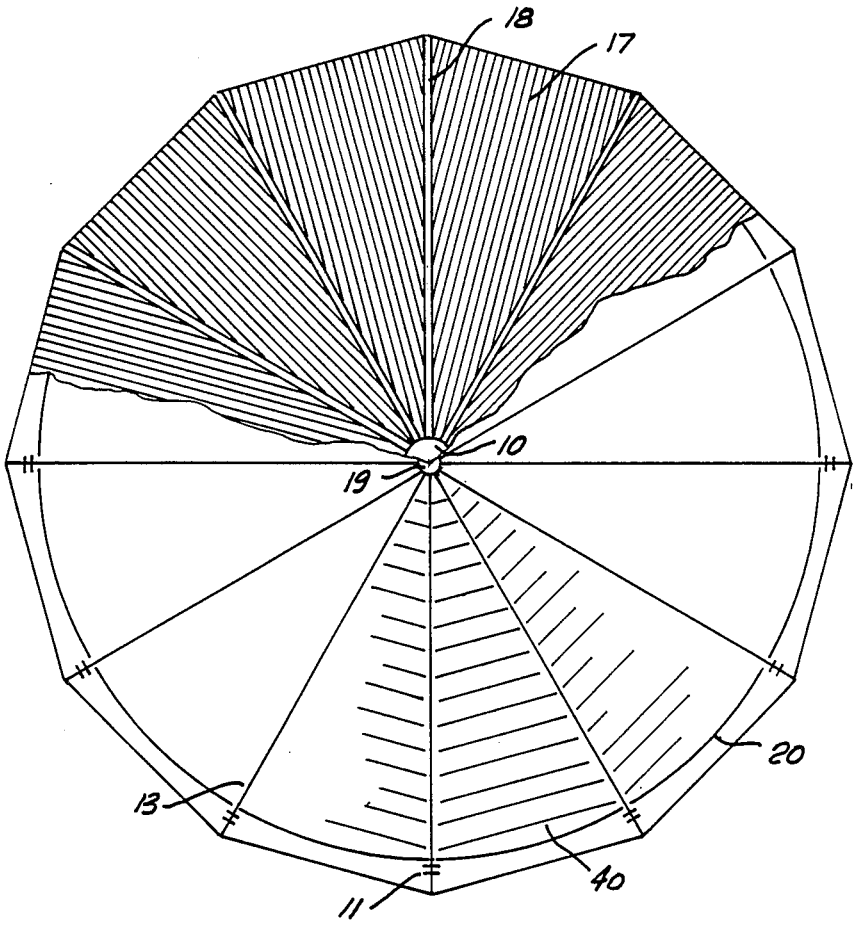
FIG. 2 is a schematic partially cut-away plan view of the structure shown in FIG. 1.

The roof is covered with sheet cladding material shown at 17 in FIG. 2 which is joined on the line of the main rafters 13 by a ridge cap 18. The peak of the roof is provided with an opening 19 provided with a removable covering 10 to allow the silo to be filled with grain.

The walls of the silo are clad with corrugated sheet wall claddingn 20 extending the height of the wall and fastened to the girts 15, for example by rivetting or bolting. The vertical edges of adjoining sheets of cladding 20 are lapped, sealed and secured together in a structural manner, for example by applying a line of mastic compound, and fastening with heavy gauge rivets so that the sheet becomes one homogeneous structural and functional element.

There is also in the roof system a tie member near the eaves which attaches to the rafters 13 to act both in tension and compression. The tie member is connected structurally to the top of the girt of the wall and completes a structural system of exceptional strength and lightness since it embodies a skin membrane construction and provides a monolithic structure.

The girts 15 which support the wall cladding 20 are a sufficient strength to resist wind loads on the whole structure and keep the building stable and at the same time provide necessary strength to cater for both even and uneven internal pressures due to the contained load.

The lower part of the container wall is supported on the concrete foundation 12 with holding down bolts.

The girts 15 are disposed at intervals along the full height of the wall with the number of girts per unit length increasing toward the bottom of the wall. The girt strengths and girt spacings are calculated taking account of the strength of the wall sheeting in bending vertically between the girts and in compression due to frictional downdrag from the grain. That is, for a given girt strength spacings are calculated for maximum desired cladding load.

In the upper part of the silo wall not influenced by local effects at the base the girt spacing is arrived at substantially from these considerations. There are other factors such as wind resistance strength that are also checked.

In the lower region of the wall adjacent the foundation the deflected profile shape of the wall must be controlled to provide a transition between the fixed lower edge and the expandable upper portion of the wall. It has been found that by carefully selecting the girt spacings in the lower region of the wall the destructive bending effects in the cladding can be overcome and the stresses in the sheeting controlled. In designs to which the invention has been applied the following spacings have been found to achieve the desired result. The spacings are expressed in terms of S, the calculated spacing for maximum cladding load at the corresponding part of the wall.

| GIRT | SPACING |
|---|---|
| 1st distance from foundation | 200 to 300 mm |
| to 1st girt | about 0.4 to 0.65 S |
| Spacing to 2nd girt | 0.5 to 0.65 S |
| Spacing to 3rd girt | 0.55 to 0.85 S |
| Spacing to 4th girt | 0.6 to 0.85 S |
| Spacing to 5th girt | 0.8 to 1.05 S |

Typically, the zone of wall, or "lower region" affected by this reduced spacing extends up the wall from the foundation a distance of 2.0 to 4.5 times the calculated gift spacing for maximum desired cladding load at the lower edge of the wall. This corresponds to an actual distance of from 1.0 to 2.5 meters.

Figure 5:
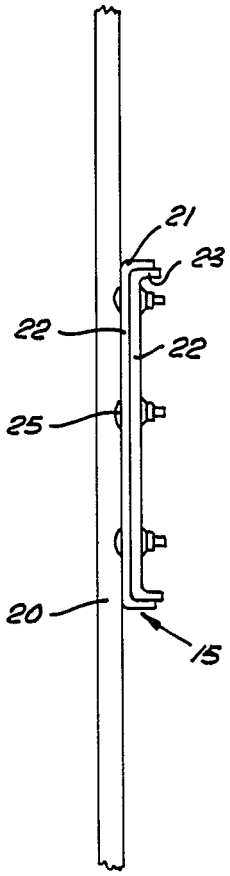
FIG. 5 is a cross section of a girt element of multiple plies according to the invention attached to wall cladding.
Figure 6:
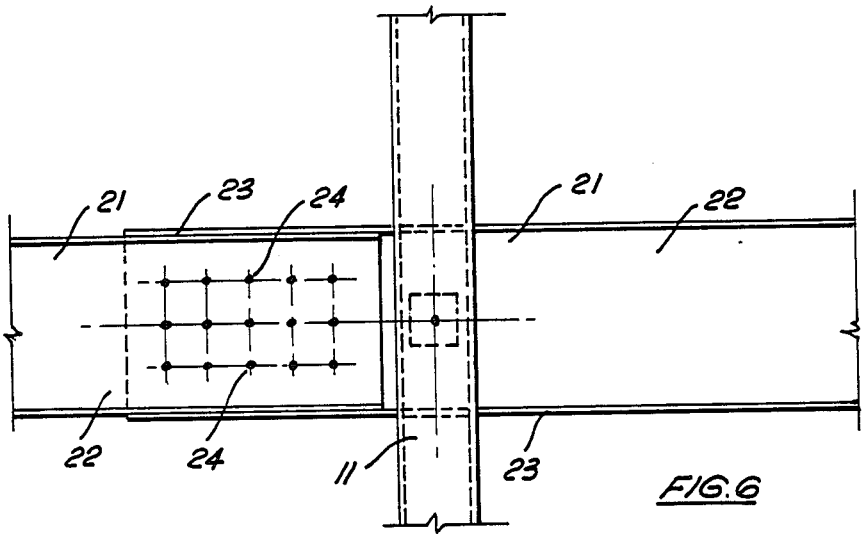
FIG. 6 is an elevation showing the connection of two girt elements according to the invention joined at a post.
Figure 7:
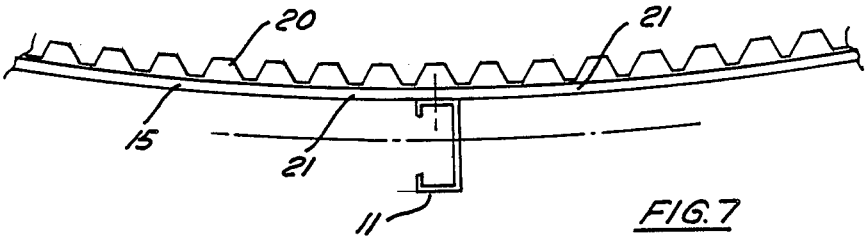
FIG. 7 is a plan view of the arrangement shown in FIG. 6.

The girts 15 are formed by a plurality of elongate channel elements 21 joined substantially end to end. The channel elements 21 comprise a band portion 22 having outwardly projecting edge flanges 23 extending along each longitudinal side. In the illustrated embodiment the flanges project at right angles to the band portion. Channel elements 21 are joined by adjacent elements 21 overlapping and nesting as best seen in FIGS. 5, 6 and 7. The overlapped band portions 22 as secured together by rivets 24. The heads 25 of rivets 24 are positioned on the inside of the girts 15 and the heads are sufficiently small to avoid interference with cladding 20. A sheet of fibrous material (not illustrated) can be placed between the cladding 20 and girts 15 to further avoid damage to the cladding 20 by rivet heads 25.

Figure 4:
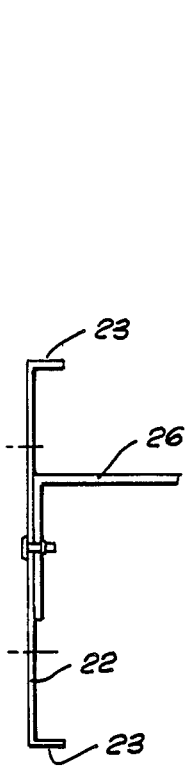
FIG. 4 is a cross section of a girt element according to the invention which has a steel angled bar attached.
Figure 3:
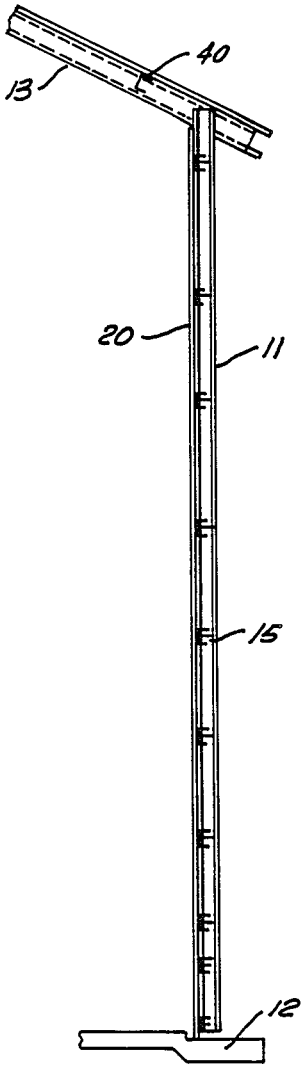
FIG. 3 is an enlargement of the part cross section shown in FIG. 1.

As shown in FIG. 4 the girts 15 can be additionally strengthened against inwardly directed forces by the addition of a wind bar 26 comprising a piece of angle steel to the elements 21 in the conventional manner.

Figure 8:
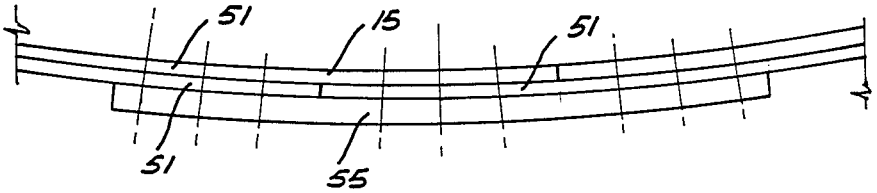
FIG. 8 is a schematic planned view of a multiple ply girt arrangement according to another embodiment of the invention.
Figure 9:
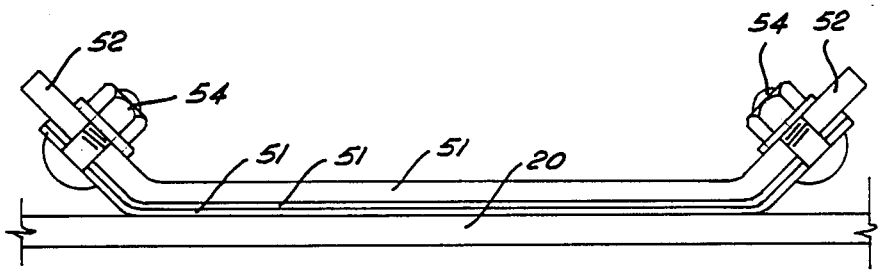
FIG. 9 is a cross sectional view along the line AA of FIG. 8.
Figure 11:
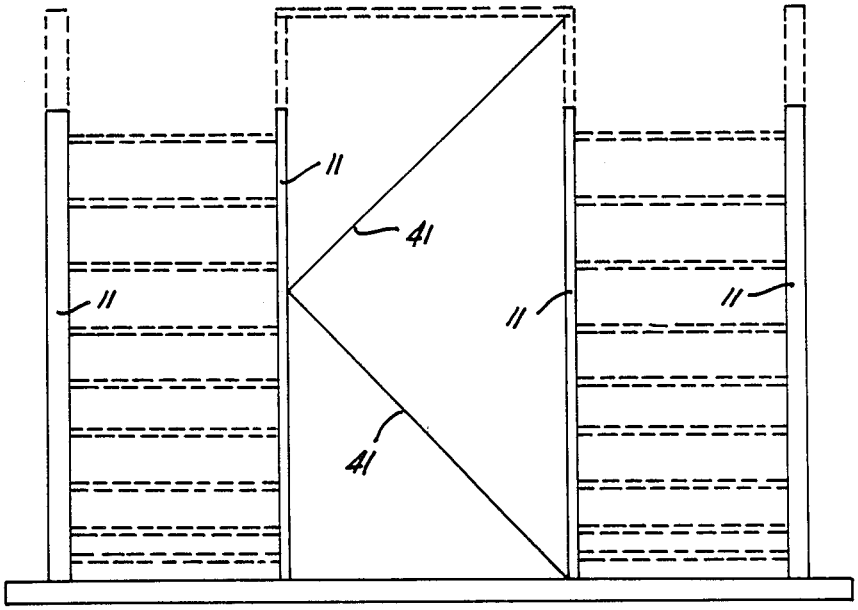
Figure 12:
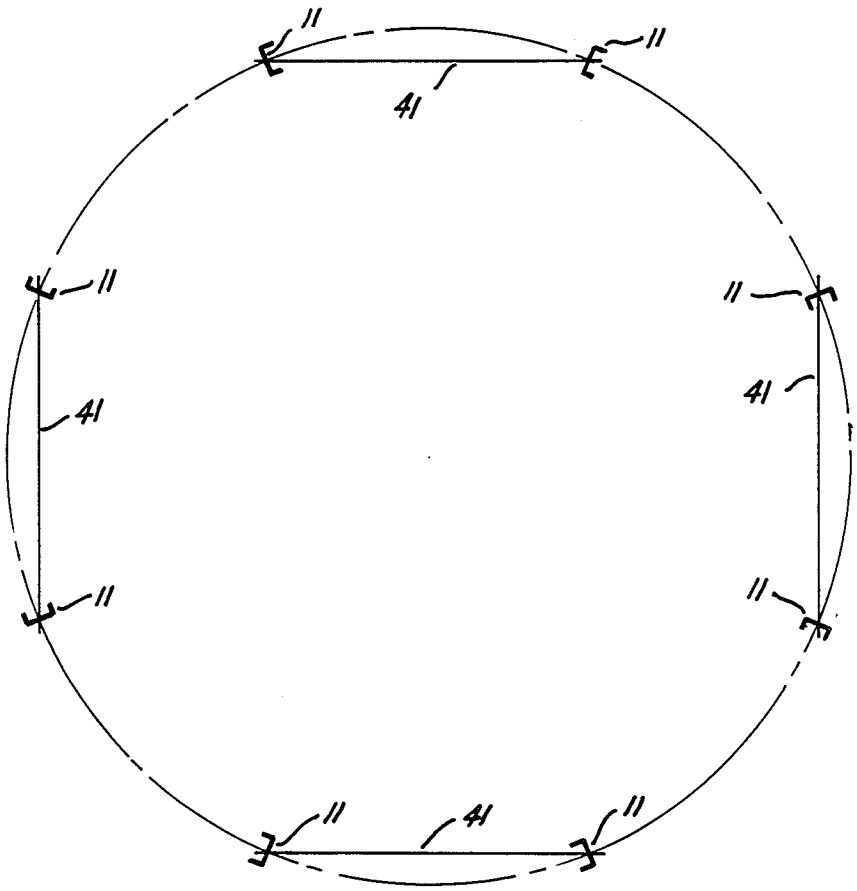

FIGS. 8 and 9 illustrate an alternate embodiment of the girt elements according to the invention. In this arrangement the elements 51 are formed with flanges 52 both of which project. These girt elements 51 are primarily for use in larger silos where the girts can become too heavy for convenient hand placement. This difficulty is overcome by using a plurality of nested girt elements 51 to provide a sufficiently strong girt. The "plies" of girt elements 51 which make up the girt are arranged in an overlapping manner as illustrated in FIG. 8. This adds additional strength to the girt and provides a convenient method of joining the girt elements 51. A splice member 55 shaped to fit inside the girt completes the joining of the girt elements.

Figure 10:
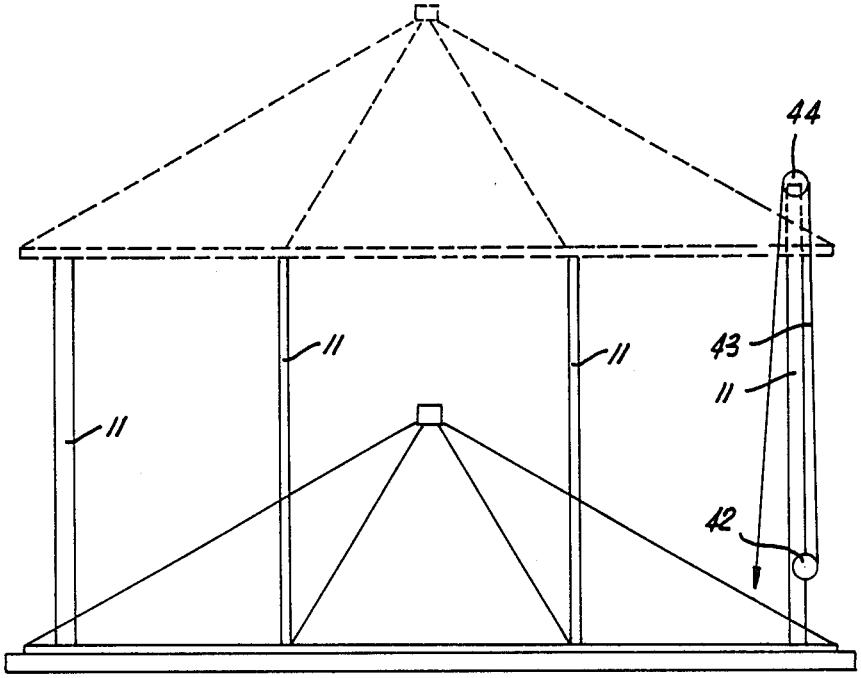
FIG. 10 is a plot of ratio of wall height to diameter against cost per cubic metre of storage.

It has in practice been found that there is a significant economic benefit associated with silos according to this invention. In particular it has been found that the squat form of silo, that is where the ratio of height ot diameter is 1 or less, that can be built according to this invention has a lower unit storage cost than comparable silos. Additionally, it is possible to show that the cost of construction of silos according to this invention varies with the ratio of wall height to diameter (H/D) and that the optimum value is less than 1. Examples below detail the cost of silos of six different capacities and several H/D ratios and the values are plotted in FIG. 10. Although the H/D ratios show greater economy at the lower end of the range other factors such as availability of land and cost of conveying equipment must also be taken into account. In practice the following H/D ratios have been found to be the maximum required.

| Silo Capacity Tonnes (Wheat) | Volume ($m^3$) | H/D Ratio |
|---|---|---|
| 500 | 641 | 1.0 |
| 2,000 | 2,564 | 0.75 |
| 5,000 | 6,410 | 0.65 |
| 10,000 | 12,821 | 0.60 |
| 20,000 | 25,641 | 0.60 |
| 30,000 | 38,642 | 0.5 |
| 50,000 | 64,103 | 0.45 |

EXAMPLE 1

Silo Capacity 500 Tonnes of Wheat (641$m^3$)

| RELATIVE COSTS BASED ON SILOS WITH CONCRETE FOUNDATION RING AND CONCRETE FLOOR. | | | | | |
|---|---|---|---|---|---|
| SILO NOM. CAP. TONNES WHEAT | 500.00 | 500.00 | 500.00 | 500.00 | 500.00 |
| VOLUME CM @ 780 KG PER CM | 641.03 | 641.03 | 641.03 | 641.03 | 641.03 |
| DIA | 12.00 | 11.00 | 10.00 | 9.10 | 8.50 |
| WALL HT. | 4.80 | 6.00 | 7.40 | 9.00 | 10.50 |
| RATIO WALL HT/DIA | .40 | .55 | .74 | .99 | 1.24 |
| PLAN AREA SQ M. | 113.10 | 95.03 | 78.54 | 65.04 | 56.75 |
| EFF. HT | 5.65 | 6.78 | 8.11 | 9.64 | 11.10 |
| ACTUAL VOLUME THESE DIMS. | 638.89 | 644.16 | 636.76 | 627.22 | 629.95 |
| FLOOR BEAM WIDTH | .90 | 1.00 | 1.10 | 1.20 | 1.40 |
| FLOOR BEAM DEPTH | .28 | .30 | .33 | .34 | .40 |
| FLOOR BEAM VOL CONC | 9.50 | 10.37 | 11.40 | 11.66 | 14.95 |
| FLOOR DIA I/S BEAM | 11.10 | 10.00 | 8.90 | 7.90 | 7.10 |
| FLOOR SLAB VOL CONC | 12.10 | 9.82 | 7.78 | 6.13 | 4.95 |
| FLOOR VOL OF CONC. CU. M. | 21.60 | 20.18 | 19.18 | 17.79 | 19.90 |
| FLOOR REINFORCEMENT SLAB | .54 | .44 | .35 | .27 | .22 |
| FLOOR REINFORCEMENT BEAM | .58 | .64 | .70 | .72 | .92 |
| FLOOR REINFT TOTAL TONNES | 1.13 | 1.08 | 1.05 | .99 | 1.14 |
| WALL AREA | 180.96 | 207.35 | 232.48 | 257.30 | 280.39 |
| WT OF WALL SHEETING | .94 | 1.07 | 1.20 | 1.33 | 1.45 |
| WT OF GIRTS AND POSTS | 3.32 | 3.81 | 4.27 | 4.73 | 5.15 |
| TOTAL WT OF WALL | 4.26 | 4.88 | 5.47 | 6.06 | 6.60 |
| ROOF AREA | 169.69 | 143.77 | 119.98 | 100.41 | 88.33 |
| WT OF ROOF SHEETING | .80 | .68 | .57 | .47 | .42 |
| WT OF RAFTERS & PURLINS ETC. | 1.09 | .93 | .77 | .65 | .57 |
| TOTAL WT OF ROOF | 1.89 | 1.61 | 1.34 | 1.12 | .99 |
| TOTAL WT STEELWK INC. SHTG | 6.15 | 6.49 | 6.81 | 7.18 | 7.59 |
| TOTAL WT OF SHEETING | 1.74 | 1.75 | 1.77 | 1.81 | 1.87 |
| COST OF SHEETING @ $1450 | $2,520 | $2,540 | $2,566 | $2,617 | $2,708 |
| TOTAL WT OF GIRTS, PURLINS, | 4.42 | 4.73 | 5.04 | 5.37 | 5.72 |
| COST OF GIRTS, PURLINS ETC @ 1500/TONNE | $6,624 | $7,100 | $7,563 | $8,058 | $8,578 |
| TRANSPORT @ $40/TONNE | $246 | $259 | $272 | $287 | $303 |
| TOTAL STRUCTURAL COST | $9,390 | $9,900 | $10,401 | $10,963 | $11,589 |
| ADJUST TO TODAY'S RATES (* 1.23) | $11,550 | $12,177 | $12,794 | $13,484 | $14,254 |
| STRUCTURAL COST/TONNE STORAGE | $23.10 | $24.35 | $25.59 | $26.97 | $28.51 |
| FORMWORK, CONCRETE, PLACING @ $240 | $5,183 | $4,844 | $4,603 | $4,270 | $4,777 |
| REINFORCEMENT @ $1000 | $1,126 | $1,078 | $1,050 | $992 | $1,142 |

-continued

| RELATIVE COSTS BASED ON SILOS WITH CONCRETE FOUNDATION RING AND CONCRETE FLOOR. | | | | | |
|---|---|---|---|---|---|
| TOTAL COST SLAB | $6,310 | $5,922 | $5,653 | $5,262 | $5,919 |
| ERECTION - 0.62* STRUCTURAL C | $7,161 | $7,550 | $7,392 | $8,360 | $8.838 |
| TOTAL COST SILOS ERECTED | $25,020 | $25,649 | $26,379 | $27,106 | $29,010 |
| File: DIM VS COST 500 | | | | | |
| COST PER TONNE OF GRAIN | $50.21 | $51.05 | $53.11 | $55.41 | $59.04 |
| COST PER CU METER STORAGE | 39.16 | 39.82 | 41.43 | 43.22 | 46.05 |

EXAMPLE 2

Silo Capacity 2,000 Tonnes of Wheat (2564m$^3$)

EXAMPLE 3

Silo Capacity 5,000 Tonnes of Wheat (6410m$^3$)

| RELATIVE COSTS BASED ON SILOS WITH CONCRETE FOUNDATION RING AND CONCRETE FLOOR. | | | | | |
|---|---|---|---|---|---|
| SILO NOM. CAP. TONNES WHEAT | 2.000 | 2,000 | 2,000 | 2,000 | 2,000 |
| VOLUME @ 780 KG PER CU M. | 2,564 | 2,564 | 2,564 | 2,564 | 2,564 |
| DIA | 20.90 | 19.30 | 17.80 | 16.80 | 22.30 |
| WALL HT. | 6.00 | 7.40 | 9.00 | 10.50 | 5.00 |
| RATIO WALL HT/DIA | .29 | .38 | .51 | .62 | .22 |
| AREA | 343.07 | 292.55 | 248.85 | 221.67 | 390.57 |
| EFF. HT | 7.48 | 8.77 | 10.26 | 11.69 | 6.58 |
| ACTUAL VOLUME THESE DIMS. | 2,566 | 2,564 | 2,553 | 2,591 | 2,569 |
| FLOOR BEAM WIDTH | 1.00 | 1.10 | 1.20 | 1.40 | .90 |
| FLOOR BEAM DEPTH | .30 | .33 | .34 | .40 | .30 |
| FLOOR BEAM VOL CONC | 19.70 | 22.01 | 22.82 | 29.56 | 18.92 |
| FLOOR DIA I/S BEAM | 19.90 | 18.20 | 16.60 | 15.40 | 21.40 |
| FLOOR SLAB VOL CONC | 38.88 | 32.52 | 27.05 | 23.28 | 44.96 |
| FLOOR VOL OF CONC. CU. M. | 58.58 | 54.53 | 49.87 | 52.84 | 63.88 |
| FLOOR REINFORCEMENT SLAB | 1.74 | 1.46 | 1.21 | 1.04 | 2.01 |
| FLOOR REINFORCEMENT BEAM | 1.21 | 1.35 | 1.40 | 1.82 | 1.16 |
| FLOOR REINFT TOTAL TONNES | 2.95 | 2.81 | 2.62 | 2.86 | 3.18 |
| WALL AREA | 393.96 | 448.68 | 503.28 | 554.18 | 350.29 |
| WT OF SHEETING | 2.04 | 2.32 | 2.60 | 2.87 | 1.81 |
| WT OF GIRTS AND POSTS | 7.24 | 8.99 | 10.08 | 11.57 | 7.60 |
| TOTAL WT OF WALL | 9.27 | 11.31 | 12.69 | 14.43 | 9.41 |
| ROOF AREA | 494.81 | 423.85 | 362.31 | 323.66 | 561.41 |
| WT OF SHEETING | 2.34 | 2.00 | 1.71 | 1.53 | 2.66 |
| WT OF RAFTERS & PURLINS ETC. | 3.18 | 2.73 | 2.33 | 2.08 | 3.61 |
| TOTAL WT OF ROOF | 5.52 | 4.73 | 4.05 | 3.62 | 6.27 |
| TOTAL WT STEELWK INC. SHTG | 14.80 | 16.04 | 16.73 | 18.05 | 15.68 |
| TOTAL WT OF SHEETING | 4.38 | 4.32 | 4.32 | 4.40 | 4.47 |
| COST OF SHEETING @ $1450 | $6,347 | $6,271 | $6,258 | $6,376 | $6,476 |
| TOTAL WT OF GIRTS, PURLINS, | 10.42 | 11.72 | 12.42 | 13.65 | 11.22 |
| COST OF GIRTS, PURLINS ETC @ 1500/TONNE | $15,631 | $17,577 | $18,624 | $20,477 | $16,825 |
| TRANSPORT @ $40/TONNE | $592 | $642 | $669 | $722 | $627 |
| TOTAL STRUCTURAL COST | $22,569 | $24,489 | $25,551 | $27,576 | $23,929 |
| ADJUST STRUC COST TO TO-DAYS RATES (* 1.23) | $27,760 | $30,122 | $31,428 | $33,918 | $29,432 |
| STRUCTURAL COST/TONNE STORAGE | $13.88 | $15.06 | $15.71 | $16.96 | $14.72 |
| FORMWORK, CONCRETE, PLACING @ $240 | $14,058 | $13,087 | $11,968 | $12,681 | $15,330 |
| REINFORCEMENT @ $1000 | $2,954 | $2,811 | $2,616 | $2,862 | $3,178 |
| TOTAL COST SLAB | $17,012 | $15,898 | $14,584 | $15,543 | $18,508 |
| ERECTION - 0.62* STRUC COST | $17,211 | $18,676 | $19,485 | $21,029 | $18,248 |
| File: DIM.COST 2000 | | | | | |
| TOTAL COST SILOS ERECTED | $61,984 | $64,696 | $65,497 | $70,490 | $66,188 |
| COST PER TONNE OF GRAIN | $30.97 | $32.34 | $32.89 | $34.88 | $33.03 |
| COST PER METER OF STORAGE | $24.16 | $25.23 | $25.66 | $27.21 | $25.76 |

| RELATIVE COSTS BASED ON SILOS WITH CONCRETE FOUNDATION RING AND CONCRETE FLOOR. | | | | | |
|---|---|---|---|---|---|
| SILO NOM. CAP. TONNES WHEAT | 5,000 | 5,000 | 5,000 | 5,000 | 5,000 |
| VOLUME @ 780 KG PER CU M. | 6,410 | 6,410 | 6,410 | 6,410 | 6,410 |
| DIA | 33.30 | 31.50 | 29.40 | 27.30 | 25.70 |
| WALL HT. | 5.00 | 6.00 | 7.40 | 9.00 | 10.50 |
| RATIO WALL HT/DIA | .15 | .19 | .25 | .33 | .41 |
| AREA | 870.92 | 779.31 | 678.87 | 585.35 | 518.75 |
| EFF. HT | 7.36 | 8.23 | 9.48 | 10.93 | 12.32 |
| ACTUAL VOLUME THESE DIMS. | 6,406 | 6,413 | 6,436 | 6,399 | 6,390 |
| FLOOR BEAM WIDTH | .90 | 1.00 | 1.10 | 1.20 | 1.40 |
| FLOOR BEAM DEPTH | .30 | .30 | .33 | .34 | .40 |
| FLOOR BEAM VOL CONC | 28.25 | 29.69 | 33.53 | 34.99 | 45.21 |
| FLOOR DIA I/S BEAM | 32.40 | 30.50 | 28.30 | 26.10 | 24.30 |

-continued

| RELATIVE COSTS BASED ON SILOS WITH CONCRETE FOUNDATION RING AND CONCRETE FLOOR. | | | | | |
|---|---|---|---|---|---|
| FLOOR SLAB VOL CONC | 103.06 | 91.33 | 78.63 | 66.88 | 57.97 |
| FLOOR VOL OF CONC. CU. M. | 131.31 | 121.02 | 112.15 | 101.87 | 103.19 |
| FLOOR REINFORCEMENT SLAB | 4.62 | 4.09 | 3.52 | 3.00 | 2.60 |
| FLOOR REINFORCEMENT BEAM | 1.74 | 1.83 | 2.06 | 2.15 | 2.78 |
| FLOOR REINFT TOTAL TONNES | 6.35 | 5.92 | 5.59 | 5.15 | 5.38 |
| WALL AREA | 523.08 | 593.76 | 683.48 | 771.89 | 847.76 |
| WT OF SHEETING | 2.70 | 3.07 | 3.53 | 3.99 | 4.38 |
| WT OF GIRTS AND POSTS | 11.35 | 10.91 | 13.70 | 15.47 | 17.69 |
| TOTAL WT OF WALL | 14.06 | 13.98 | 17.23 | 19.46 | 22.08 |
| ROOF AREA | 1230.74 | 1103.48 | 963.77 | 833.51 | 740.61 |
| WT OF SHEETING | 5.82 | 5.22 | 4.56 | 3.94 | 3.50 |
| WT OF RAFTERS & PURLINS ETC. | 7.92 | 7.10 | 6.20 | 5.36 | 4.77 |
| TOTAL WT OF ROOF | 13.74 | 12.32 | 10.76 | 9.31 | 8.27 |
| TOTAL WT STEELWK INC. SHTG | 27.80 | 26.30 | 27.99 | 28.76 | 30.35 |
| TOTAL WT OF SHEETING | 8.53 | 8.29 | 8.09 | 7.93 | 7.89 |
| COST OF SHEETING @ $1450 | $12,362 | $12,019 | $11,734 | $11,503 | $11,435 |
| TOTAL WT OF GIRTS, PURLINS, | 19.27 | 18.01 | 19.90 | 20.83 | 22.46 |
| COST OF GIRTS, PURLINS ETC @ 1500/TONNE | $28,912 | $27,011 | $29,846 | $31,246 | $33,691 |
| TRANSP0RT @ $40/TONNE | $1,112 | $1,052 | $1,120 | $1,151 | $1,214 |
| TOTAL STRUCTURAL COST | $42,387 | $40,082 | $42,700 | $43,900 | $46,340 |
| ADJUST STRUC COST TO TO-DAYS RATES (* 1.23) | $52,136 | $49,301 | $52,521 | $53,996 | $56,988 |
| STRUCTURAL COST/TONNE STORAGE | $10.43 | $9.86 | $10.50 | $10.80 | $11.40 |
| FORMWORK, CONCRETE, PLACING @ $240 | $31,513 | $29,044 | $26,917 | $24,449 | $24,764 |
| REINFORCEMENT @ $1000 | $6,355 | $5,918 | $5,585 | $5,149 | $5,379 |
| TOTAL COST SLAB | $37,868 | $34,961 | $32,502 | $29,598 | $30,143 |
| ERECTION - 0.62* STRUC COST | $32,324 | $30,567 | $32,563 | $33,478 | $35,339 |
| TOTAL COST SILOS ERECTED | $122,328 | $114,829 | $117,586 | $117,072 | $122,480 |
| File: DIM V COST 5000 | | | | | |
| COST PER TONNE OF GRAIN | $24.48 | $22.96 | $23.42 | $23.46 | $24.57 |
| COST PER CU. METER STORAGE | $19.09 | $17.91 | $18.27 | $18.30 | $19.17 |

EXAMPLE 4

Silo Capacity 10,000 Tonnes of Wheat (12,821m$^3$)

| RELATIVE COSTS BASED ON SILOS WITH CONCRETE FOUNDATION RING AND CONCRETE FLOOR. | | | | | | |
|---|---|---|---|---|---|---|
| SILO NOM. CAP. TONNES WHEAT | 10,000 | 10,000 | 10,000 | 10,000 | 10,000 | 10,000 |
| VOLUME CM @ 780 KG/CM | 12,821 | 12,821 | 12,821 | 12,821 | 12,821 | 12,821 |
| DIA | 42.60 | 40.00 | 37.50 | 35.40 | 33.70 | 30.00 |
| WALL HT. | 6.00 | 7.40 | 9.00 | 10.50 | 12.00 | 16.00 |
| RATIO WALL HT/DIA | .14 | .18 | .24 | .30 | .36 | .53 |
| AREA | 1425.31 | 1256.64 | 1104.47 | 984.23 | 891.97 | 706.86 |
| EFF. HT | 9.01 | 10.23 | 11.65 | 13.00 | 14.38 | 18.12 |
| ACTUAL VOLUME THESE DIMS. | 12,848 | 12,855 | 12,871 | 12,799 | 12,830 | 12,810 |
| FLOOR BEAM WIDTH | 1.10 | 1.10 | 1.20 | 1.40 | 1.50 | 1.60 |
| FLOOR BEAM DEPTH | .33 | .33 | .34 | .40 | .42 | .44 |
| FLOOR BEAM VOL CONC | 48.58 | 45.62 | 48.07 | 62.28 | 66.70 | 66.35 |
| FLOOR DIA I/S BEAM | 41.50 | 38.90 | 36.30 | 34.00 | 32.20 | 28.40 |
| FLOOR SLAB VOL CONC | 169.08 | 148.56 | 129.36 | 113.49 | 101.79 | 79.18 |
| FLOOR VOL OF CONC. CU. M. | 217.66 | 194.17 | 177.43 | 175.77 | 168.49 | 145.53 |
| FLOOR REINFORCEMENT SLAB | 7.57 | 6.65 | 5.79 | 5.08 | 4.56 | 3.55 |
| FLOOR REINFORCEMENT BEAM | 2.99 | 2.81 | 2.96 | 3.83 | 4.10 | 4.08 |
| FLOOR REINFT TOTAL TONNES | 10.56 | 9.46 | 8.75 | 8.92 | 8.66 | 7.63 |
| WALL AREA | 802.99 | 929.91 | 1060.29 | 1167.73 | 1270.46 | 1507.96 |
| WT OF SHEETING | 7.23 | 8.37 | 9.54 | 11.68 | 12.70 | 15.08 |
| WT OF GIRTS AND POSTS | 21.42 | 24.81 | 28.28 | 31.15 | 33.89 | 40.23 |
| TOTAL WT OF WALL | 28.65 | 33.18 | 37.83 | 42.83 | 46.59 | 55.31 |
| ROOF AREA | 1998.89 | 1765.47 | 1554.70 | 1388.00 | 1259.97 | 1002.72 |
| WT OF SHEETING | 9.45 | 8.35 | 7.35 | 6.57 | 5.96 | 4.74 |
| WT OF RAFTERS & PURLINS ETC. | 13.19 | 11.36 | 10.01 | 8.93 | 8.11 | 6.45 |
| TOTAL WT OF ROOF | 22.65 | 19.71 | 17.36 | 15.50 | 14.07 | 11.20 |
| TOTAL WT STEELWK INC. SHTG | 51.30 | 52.89 | 55.19 | 58.33 | 60.66 | 66.50 |
| TOTAL WT OF SHEETING | 16.68 | 16.72 | 16.90 | 18.24 | 18.66 | 19.82 |
| COST OF SHEETING @ $1450 | $24,188 | $24,244 | $24,500 | $26,452 | $27,063 | $28,743 |
| TOTAL WT OF GIRTS, PURLINS, | 34.61 | 36.17 | 38.29 | 40.08 | 42.00 | 46.68 |
| COST OF GIRTS, PURLINS ETC @ 1500/TONNE | $51,921 | $54,252 | $57,434 | $60,127 | $62,999 | $70,019 |
| TRANSPORT @ $40/TONNE | $2,052 | $2,116 | $2,207 | $2,333 | $2,427 | $2,660 |
| TOTAL STRUCTURAL COST | $78,162 | $80,611 | $84,141 | $88,912 | $92,488 | $101,421 |
| ADJUST STRUC COST TO TO-DAYS RATES (* 1.23) | $96,139 | $99,152 | $103,494 | $109,361 | $113,761 | $124,748 |
| STRUCTURAL COST/TONNE STORAGE | $9.61 | $9.92 | $10.35 | $10.94 | $11.38 | $12.47 |
| FORMWORK, CONCRETE, PLACING | $52,239 | $46,602 | $42,583 | $42,185 | $40,438 | $34,928 |

-continued

| RELATIVE COSTS BASED ON SILOS WITH CONCRETE FOUNDATION RING AND CONCRETE FLOOR. | | | | | | |
|---|---|---|---|---|---|---|
| @ $240 | | | | | | |
| REINFORCEMENT @ $1000 | $10,563 | $9,462 | $8,753 | $8,916 | $8,664 | $7,630 |
| TOTAL COST SLAB | $62,802 | $56,064 | $51,336 | $51,101 | $49,102 | $42,558 |
| ERECTION - 0.62* STRUC COST | $59,606 | $61,474 | $64,166 | $67,804 | $70,532 | $77,344 |
| File: DIM.COST 10000 | | | | | | |
| TOTAL COST SILOS ERECTED | $218,547 | $216,690 | $218,996 | $228,266 | $233,394 | $244,651 |
| COST PER TONNE OF GRAIN | $21.85 | $21.67 | $21.90 | $22.83 | $23.34 | $24.47 |
| COST PER CU. METER STORAGE | $17.01 | $16.86 | $17.02 | $17.83 | $18.19 | $19.10 |

EXAMPLE 5

Silo Capacity 20,000 Tonnes of Wheat (25,641m$^3$)

EXAMPLE 6

Silo Capacity 30,000 Tonnes of Wheat (38,462m$^3$)

| RELATIVE COSTS BASED ON SILOS WITH CONCRETE FOUNDATION RING AND CONCRETE FLOOR | | | | | | | | |
|---|---|---|---|---|---|---|---|---|
| SILO NOM. CAP. TONNES WHEAT | 20,000 | 20,000 | 20,000 | 20,000 | 20,000 | 20,000 | 20,000 | 20,000 |
| VOLUME CM @ 780 KG/CM | 25,641 | 25,641 | 25,641 | 25,641 | 25,641 | 25,641 | 25,641 | 25 641 |
| DIA | 57.00 | 54.00 | 51.00 | 48.50 | 46.20 | 41.50 | 38.00 | 35.00 |
| WALL HT. | 6.00 | 7.40 | 9.00 | 10.50 | 12.00 | 16.00 | 20.00 | 24.00 |
| RATIO WALL HT/DIA | .11 | .14 | .18 | .22 | .26 | .39 | .53 | .69 |
| AREA | 2551.76 | 2290.23 | 2042.83 | 1847.46 | 1676.39 | 1352.66 | 1134.12 | 962.12 |
| EFF. HT | 10.03 | 11.22 | 12.61 | 13.93 | 15.27 | 18.94 | 22.69 | 26.48 |
| ACTUAL VOLUME THESE DIMS. | 25,601 | 25,697 | 25,756 | 25,738 | 25,596 | 25,614 | 25,731 | 25,473 |
| FLOOR BEAM WIDTH | 1.10 | 1.10 | 1.20 | 1.40 | 1.50 | 1.60 | 1.70 | 1.80 |
| FLOOR BEAM DEPTH | .33 | .33 | .34 | .40 | .42 | .44 | .45 | .47 |
| FLOOR BEAM VOL CONC | 65.00 | 61.58 | 65.37 | 85.33 | 91.44 | 91.78 | 91.33 | 93.02 |
| FLOOR DIA I/S BEAM | 55.90 | 52.90 | 49.80 | 47.10 | 44.70 | 39.90 | 36.30 | 33.20 |
| FLOOR SLAB VOL CONC | 306.78 | 274.73 | 243.48 | 217.79 | 196.16 | 156.30 | 129.36 | 108.21 |
| FLOOR VOL OF CONC. CU. M. | 371.78 | 336.31 | 308.85 | 303.12 | 287.60 | 248.08 | 220.69 | 201.23 |
| FLOOR REINFORCEMENT SLAB | 13.74 | 12.31 | 10.91 | 9.76 | 8.79 | 7.00 | 5.79 | 4.85 |
| FLOOR REINFORCEMENT BEAM | 4.00 | 3.79 | 4.02 | 5.25 | 5.63 | 5.65 | 5.62 | 5.72 |
| FLOOR REINFT TOTAL TONNES | 17.74 | 16.10 | 14.93 | 15.01 | 14.41 | 12.65 | 11.41 | 10.57 |
| WALL AREA | 1074.42 | 1255.38 | 1441.99 | 1599.86 | 1741.70 | 2086.02 | 2387.61 | 2638.94 |
| WT OF wall SHEETING tonnes | 10.72 | 12.52 | 16.18 | 19.95 | 21.72 | 26.01 | 29.77 | 32.91 |
| WT OF GIRTS AND POSTS | 26.12 | 30.52 | 35.06 | 38.90 | 42.35 | 50.72 | 58.06 | 64.17 |
| TOTAL WT OF WALL | 36.84 | 43.05 | 51.25 | 58.85 | 64.07 | 76.73 | 87.83 | 97.07. |
| ROOF AREA | 3553.87 | 3193.28 | 2851.97 | 2582.27 | 2345.98 | 1898.37 | 1595.78 | 1357.32 |
| WT OF ROOF SHEETING tonnes | 16.81 | 15.10 | 13.49 | 12.21 | 11.10 | 8.98 | 7.55 | 6.42 |
| WT OF RAFTERS & PURLINS ETC. | 23.46 | 20.55 | 18.35 | 16.62 | 15.10 | 12.22 | 10.27 | 8.74 |
| TOTAL WT OF ROOF | 40.27 | 35.66 | 31.84 | 28.83 | 26.19 | 21.20 | 17.82 | 15.16 |
| TOTAL WT STEELWK INC. SHTG | 77.11 | 78.70 | 83.09 | 87.68 | 90.26 | 97.93 | 105.65 | 112.23 |
| TOTAL WT OF SHEETING ROOF & WALL | 27.53 | 27.63 | 29.67 | 32.16 | 32.82 | 34.99 | 37.32 | 39.33 |
| COST OF SHEETING @ $1450 | $39,916 | $40,060 | $43,026 | $46,638 | $47,582 | $50,738 | $54,116 | $57,025 |
| TOTAL WT OF GIRTS, PURLINS, | 49.58 | 51.08 | 53.42 | 55.52 | 57.45 | 62.94 | 68.33 | 72.90 |
| COST OF GIRTS, PURLINS ETC @ 1500/TONNE | $74,374 | 76,614 | 80,125 | 83,279 | 86,174 | 94,409 | 102,488 | 109,353 |
| TRANSPORT @ $40/TONNE | $3,084 | $3,148 | $3,324 | $3,507 | $3,611 | $3,917 | $4,226 | $4,489 |
| TOTAL STRUCTURAL COST $ | 117,375 | 119,822 | 126,475 | 133,425 | 137,367 | 149,065 | 160,830 | 170,867 |
| ADJUST STRUC COST TO TO-DAYS RATES (* 1.23) | 144,371 | 147,381 | 155,564 | 164,113 | 168,961 | 183,350 | 197,821 | 210,166 |
| STRUCTURAL COST/TONNE STORAGE | $7.22 | $7.37 | $7.78 | $8.21 | $8.45 | $9.17 | $9.89 | $10.51 |
| FORMWORK, CONCRETE, PLACING @ $240 | $89,227 | $80,716 | $74,123 | $72,748 | $69,024 | $59,539 | $52,966 | $48,296 |
| REINFORCEMENT @ $1000 | $17,742 | $16,096 | $14,929 | $15,006 | $14,414 | $12,649 | $11,415 | $10,572 |
| TOTAL COST SLAB | 106,969 | $96,811 | $89,052 | $87,755 | $83,438 | $72,188 | $64,380 | $58,868 |
| ERECTION - 0.62* STRUC COST | 89,510 | 91,376 | 96,450 | 101,750 | 104,756 | 113,677 | 122,649 | 130,303 |
| File: DIM.COST 20000s | | | | | | | | |
| TOTAL COST SILOS ERECTED | $340,850 | 335,569 | 341,066 | 353,617 | 357,156 | 369,215 | 384,851 | 399,338 |
| COST PER TONNE OF GRAIN | $17.07 | $16.74 | $16.98 | $17.61 | $17.89 | $18.48 | $19.17 | $20.10 |
| COST PER CU. METER STORAGE | $13.31 | $13.06 | $13.24 | $13.74 | $13.95 | $14.41 | $14.96 | $15.68 |

| RELATIVE COSTS BASED ON SILOS WITH CONCRETE FOUNDATION RING AND CONCRETE FLOOR | | | | | | | | |
|---|---|---|---|---|---|---|---|---|
| SILO NOM. CAP. TONNES WHEAT | 30,000 | 30,000 | 30,000 | 30,000 | 30,000 | 30,000 | 30,000 | 30,000 |
| VOLUME CM @ 780 KG/CM | 38,462 | 38,462 | 38,462 | 38,462 | 38,462 | 38,462 | 38,462 | 38,462 |
| DIA | 67.50 | 64.20 | 60.70 | 58.00 | 55.50 | 50.10 | 46.00 | 42.60 |
| WALL HT. | 6.00 | 7.40 | 9.00 | 10.50 | 12.00 | 16.00 | 20.00 | 24.00 |
| RATIO WALL HT/DIA | .09 | .12 | .15 | .18 | .22 | .32 | .43 | .56 |
| AREA | 3578.48 | 3237.14 | 2893.80 | 2642.09 | 2419.23 | 1971.36 | 1661.91 | 1425.31 |
| EFF. HT | 10.78 | 11.94 | 13.29 | 14.60 | 15.93 | 19.54 | 23.25 | 27.01 |
| ACTUAL VOLUME THESE DIMS. | 38,560 | 38,658 | 38,472 | 38,584 | 38,530 | 38,529 | 38,647 | 38,503 |
| FLOOR BEAM WIDTH | 1.10 | 1.10 | 1.20 | 1.40 | 1.50 | 1.60 | 1.70 | 1.80 |
| FLOOR BEAM DEPTH | .33 | .33 | .34 | .40 | .42 | .44 | .45 | .47 |
| FLOOR BEAM VOL CONC | 76.98 | 73.21 | 77.80 | 102.04 | 109.85 | 110.81 | 110.55 | 113.22 |

-continued

| RELATIVE COSTS BASED ON SILOS WITH CONCRETE FOUNDATION RING AND CONCRETE FLOOR | | | | | | | | |
|---|---|---|---|---|---|---|---|---|
| FLOOR DIA I/S BEAM | 66.40 | 63.10 | 59.50 | 56.60 | 54.00 | 48.50 | 44.30 | 40.80 |
| FLOOR SLAB VOL CONC | 432.85 | 390.89 | 347.56 | 314.51 | 286.28 | 230.93 | 192.67 | 163.43 |
| FLOOR VOL OF CONC. CU. M. | 509.83 | 464.11 | 425.37 | 416.55 | 396.12 | 341.74 | 303.22 | 276.65 |
| FLOOR REINFORCEMENT SLAB | 19.39 | 17.51 | 15.57 | 14.09 | 12.82 | 10.34 | 8.63 | 7.32 |
| FLOOR REINFORCEMENT BEAM | 4.74 | 4.51 | 4.79 | 6.28 | 6.76 | 6.82 | 6.80 | 6.97 |
| FLOOR REINFT TOTAL TONNES | 24.13 | 22.01 | 20.36 | 20.37 | 19.58 | 17.16 | 15.43 | 14.29 |
| WALL AREA | 1272.35 | 1492.51 | 1716.25 | 1913.23 | 2092.30 | 2518.30 | 2890.27 | 3211.96 |
| WT OF wall SHEETING tonnes | 15.27 | 17.91 | 23.17 | 28.70 | 31.38 | 37.77 | 43.35 | 48.18 |
| WT OF GIRTS AND POSTS | 30.94 | 36.29 | 41.74 | 46.53 | 50.88 | 61.24 | 70.28 | 78.11 |
| TOTAL WT OF WALL | 46.21 | 54.20 | 64.90 | 75.22 | 82.26 | 99.01 | 113.64 | 126.29 |
| ROOF AREA | 4967.81 | 4497.98 | 4025.16 | 3678.36 | 3371.17 | 2753.34 | 2325.97 | 1998.99 |
| WT OF ROOF SHEETING tonnes | 23.50 | 21.28 | 19.04 | 17.40 | 15.95 | 13.02 | 11.00 | 9.45 |
| WT OF RAFTERS & PURLINS ETC. | 32.79 | 28.95 | 25.90 | 23.67 | 21.70 | 17.72 | 14.97 | 12.86 |
| TOTAL WT OF ROOF | 56.29 | 50.22 | 44.94 | 41.07 | 37.64 | 30.74 | 25.97 | 22.32 |
| TOTAL WT STEELWK INC. SHTG | 102.50 | 104.43 | 109.85 | 116.30 | 119.90 | 129.76 | 139.61 | 148.61 |
| TOTAL WT OF SHEETING ROOF & WALL | 38.77 | 39.19 | 42.21 | 46.10 | 47.33 | 50.80 | 54.36 | 57.63 |
| COST OF SHEETING, @ 1450 | $56,211 | $56,819 | $61,202 | $66,841 | $68,629 | $73,657 | $78,816 | $83,570 |
| TOTAL WT OF GIRTS, PURLINS, | 63.73 | 65.24 | 67.64 | 70.20 | 72.57 | 78.96 | 85.25 | 90.97 |
| COST OF GIRTS, PURLINS ETC @ 1500/TONNE | $95,597 | 97,863 | 101,460 | 105,297 | 108,859 | 118,438 | 127,881 | 136,458 |
| TRANSPORT @ $40/TONNE | $4,100 | $4,177 | $4,394 | $4,652 | $4,796 | $5,190 | $5,584 | $5,944 |
| TOTAL STRUCTURAL COST $ | 155,907 | 158,859 | 167,056 | 176,790 | 182,283 | 197,285 | 212,281 | 225,972 |
| ADJUST STRUC COST TO TO-DAYS RATES (* 1.23) | 191,766 | 195,396 | 205,479 | 217,451 | 224,209 | 242,661 | 261,106 | 277,945 |
| STRUCTURAL COST/TONNE STORAGE | $6.39 | $6.51 | $6.85 | $7.25 | $7.47 | $8.09 | $8.70 | $9.26 |
| FORMWORK, CONCRETE, PLACING @ $240 | 122,358 | 111,386 | 102,088 | 99,971 | 95,070 | 82,017 | 72,773 | 66,395 |
| REINFORCEMENT @ $1000 | $24,126 | $22,015 | $20,356 | $20,367 | $19,583 | $17,163 | $15,433 | $14,288 |
| TOTAL COST SLAB | 146,484 | 133,400 | 122,444 | 120,339 | 114,653 | 99,180 | 88,206 | 80,683 |
| ERECTION - 0.62* STRUC COST | 118,895 | 121,146 | 127,397 | 134,820 | 139,009 | 150,450 | 161,886 | 172,326 |
| File: DIM.COST 30000 | | | | | | | | |
| TOTAL COST SILOS ERECTED | 457,145 | 449,942 | 455,320 | 472,610 | 477,870 | 492,291 | 511,197 | 530,954 |
| COST PER TONNE OF GRAIN | $15.20 | $14.92 | $15.17 | $15.70 | $15.90 | $16.38 | $16.96 | $17.68 |
| COST PER CU. METER STORAGE | $11.86 | $11.64 | $11.84 | $12.25 | $12.40 | $12.78 | $13.23 | $13.79 |

I claim:

1. An enclosed structure suitable for containing particulate solids comprising a plurality of posts set on foundations so as to define the external boundary of said structure, a plurality of rafters extending upwardly and inwardly from each said post to a central point or ridge, a plurality of circumferential girts extending substantially horizontally between said posts so as to define the line of a cornerless substantially circular wall, vertically corrugated sheet metal wall cladding extending the height of said wall and being fixed to the foundations at its lower edge, said sheet cladding being located within the wall defined by said girts and being fastened to said girts, the vertical edges of adjoining sheets of cladding being secured together by connecting means, and roof cladding being placed over said rafters to form a roof, wherein the ratio of the height of the wall to diameter of said wall is less than or equal to 1.0 and each said girt is formed by a plurality of elongate channel elements joined substantially end to end, said girts being disposed at intervals along the full height of said wall with the number of girts per unit length increasing toward the bottom of said wall such that in a lower region of said wall and girt spacings are less than the calculated girt spacing for maximum desired cladding load at the corresponding part of said wall to control the deflected profile shape of the wall cladding between the fixed lower edge and the expanding upper region of said wall, said lower region being that portion of the wall at a distance from said lower edge of said cladding of less than about 2.0 to 4.5 times the calculated girt spacing for maximum desired cladding load at said lower edge of said wall, the spacing to the first lower most girt from the foundation being about 0.4 to 0.6 S, the spacing to the second girt being about 0.5 to 0.7 S, the spacing to the third girt being about 0.55 to 0.8 S, the spacing to the fourth girt being about 0.6 to 0.8 S, and the spacing to the fifth girt being about 0.8 to 1.0 S where S is the calculated girt spacing for maximum desired cladding load at the corresponding part of said wall.

2. An enclosed structure as claimed in claim 1 wherein said channel elements include a band portion having opposite edges from each of which edge flanges extend parallel to each other and at right angles to said band portion.

3. An enclosed structure as claimed in claim 1 wherein said channel elements have edge flanges and said edge flanges of said channel elements project in outwardly.

4. An enclosed structure as claimed in claim 1 wherein said channel elements have edge flanges and said edge flanges allow the channel elements to be manually curved to the shape of the structure.

5. An enclosed structure as claimed in claim 1 wherein said channel elements are joined by a splice plate overlapping the ends of adjacent channel elements and fastened to the band portions.

6. An enclosed structure as claimed in claim 1 wherein the channel elements are joined by adjacent elements overlapping and nesting one within the other.

7. An enclosed structure as claimed in claim 6 wherein fastening means extend through the overlaped band portions of the adjacent channel elements.

8. An enclosed structure as claimed in claim 6 wherein fastening means extend through the overlapped edge flanges of the adjacent channel elements.

* * * * *